US009254989B2

(12) United States Patent
Kingery

(10) Patent No.: US 9,254,989 B2
(45) Date of Patent: Feb. 9, 2016

(54) HEAVY DUTY RATCHET

(71) Applicant: Kenneth G. Kingery, Mesa, AZ (US)

(72) Inventor: Kenneth G. Kingery, Mesa, AZ (US)

( * ) Notice: Subject to any disclaimer, the term of this patent is extended or adjusted under 35 U.S.C. 154(b) by 227 days.

(21) Appl. No.: 13/869,469

(22) Filed: Apr. 24, 2013

(65) Prior Publication Data

US 2013/0277630 A1 Oct. 24, 2013

Related U.S. Application Data

(63) Continuation-in-part of application No. 13/653,647, filed on Oct. 17, 2012.

(60) Provisional application No. 61/548,140, filed on Oct. 17, 2011.

(51) Int. Cl.

| | |
|---|---|
| ***B21F 9/00*** | (2006.01) |
| ***B66F 3/00*** | (2006.01) |
| ***B66D 3/08*** | (2006.01) |
| ***B66D 5/32*** | (2006.01) |
| ***B66D 3/10*** | (2006.01) |

(52) U.S. Cl.

CPC ... *B66D 5/32* (2013.01); *B66D 3/10* (2013.01)

(58) Field of Classification Search

USPC ..... 254/214, 218, 221, 223, 393

See application file for complete search history.

(56) References Cited

U.S. PATENT DOCUMENTS

| | | | | |
|---|---|---|---|---|
| 4,533,026 | A * | 8/1985 | Bernard | 188/184 |
| 4,977,795 | A * | 12/1990 | McVey | 74/575 |
| D362,614 | S | 9/1995 | Kingery | |
| 5,511,447 | A * | 4/1996 | Galloway et al. | 74/577 S |
| 5,868,380 | A * | 2/1999 | Allen | 254/391 |
| 6,068,242 | A * | 5/2000 | Kingery | 254/391 |
| 6,092,791 | A * | 7/2000 | Kingery | 254/371 |
| 6,305,669 | B1 * | 10/2001 | Harken et al. | 254/412 |
| 6,684,805 | B2 * | 2/2004 | Curchod | 114/218 |
| 6,971,636 | B1 * | 12/2005 | Habberstad | 254/406 |
| 7,350,767 | B2 * | 4/2008 | Huang | 254/218 |
| 7,445,195 | B1 * | 11/2008 | Huang | 254/391 |
| 7,537,199 | B1 * | 5/2009 | Anderson | 254/411 |

(Continued)

OTHER PUBLICATIONS

Website page, www.bmcintyrestudio.com, Quick Release Tie Down (1 page).

(Continued)

*Primary Examiner* — Emmanuel M Marcelo

(74) *Attorney, Agent, or Firm* — The von Hellens Law Firm, Ltd.

(57) ABSTRACT

A ratchet includes a spool rotatably disposed within a housing and supporting a cord having opposed cord sections extending from the housing. Tension to one cord section is initially applied by pulling on the other cord section. To increase the tension, a tool is engaged with the spool to apply a further force to increase the tension on the one cord section. In another embodiment, a cord enters the housing and into the center of a hollow shaft supporting a spool and drawn through the hollow shaft to establish an initial degree of tension on the section of the cord entering the housing. A lever cooperating with the spool turns the spool to wrap the cord about the spool and increase the tension on the cord. In a third embodiment, a cord enters a housing and extends about a spool supported within the housing and thereafter exits the housing. A pivotable lever incrementally rotates the spool to increase the tension on the cord entering the housing. To further increase the tension on the spool, a wrench or the like may engage the shaft supporting the spool in any of the ratchets described.

18 Claims, 9 Drawing Sheets

(56) References Cited

U.S. PATENT DOCUMENTS

| | | | | |
|---|---|---|---|---|
| 7,562,862 | B1 * | 7/2009 | Jackson | 254/376 |
| 7,673,851 | B2 * | 3/2010 | Lange | 254/409 |
| 7,762,531 | B2 * | 7/2010 | Bond | 254/218 |
| 7,862,008 | B2 * | 1/2011 | Woodruff | 254/218 |
| 2001/0045548 | A1 * | 11/2001 | Landy | 254/217 |
| 2011/0204306 | A1 * | 8/2011 | Kingery | 254/391 |

OTHER PUBLICATIONS

Website page, www.trupoint.com, Tight-Rope Tie Down (1 page).
Website page, www.qualitymarinesupply.com, On-line Boating Store (4 pages).
Website page, USA Products Group (3 pages).
Website page, www.drillspot.com, Rope Ratchet (1 page).
Website page, www.homehardware.com, Tie Down Rope (1 page).
Website page, www.ericksonmfg.com, Rope Ratchet (1 page).
Website page, www.roperatchet.com, Rope Ratchet (2 pages).
Website page, www.toolking.com, Keeper 07007 Rope Wrangler Rope Tie Down (2 pages).
Website page, www.hamptonproducts.com, Rope Wrangler (1 page).
Website page, www.ropetiedowns.com, Rope Tie Downs, Inc. (1 page).
Website page, www.etrailer.com, Cargo Tie Downs (2 pages).
Website page, www.inlandtarp.net, Super Cinch Tie Down (1 page).
Website page, www.rockymountainhondapowerhouse.com, QuadPak Toughman Rope Clamp (1 page).
Website page, www.discountramps.com, Rope Tie Down (2 pages).
Website page, www.tieboss.com, Tie Down (2 pages).
Website page, www.qdmaqi.com, Rope Tie Down (1 page).
Website page, www.media.hydroponics.net, Rope Ratchet (1 page).
Advertisement, "Rope Ratchet Tie Down", Carolina North (2 pages).

* cited by examiner

HEAVY DUTY RATCHET

CROSS REFERENCE TO RELATED APPLICATIONS

The present application claims priority to utility application entitled "TENSIONING ASSEMBLY", assigned Ser. No. 13/653,647 and filed Oct. 17, 2012, and which claims priority to a provisional patent application entitled "TENSIONING ASSEMBLY", assigned Ser. No. 61/548,140 and filed Oct. 17, 2011, both of which describe inventions made by the present inventor.

BACKGROUND OF THE INVENTION

1. Field of the Invention

The present invention relates to ratchets and, more particularly, to heavy duty ratchets.

2. Description of Related Prior Art

Ratchets for use with cords of various types have been commercially available for a period of years. U.S. Pat. Nos. 6,068,242, 6,092,791, and Des. 362,614 are representative and are incorporated herein by reference. A ratchet of this type includes a housing having a hook or like member for attaching the ratchet to an anchor point. A spool within the housing supports a cord partially wrapped thereabout and extending from within the housing. The spool includes a ring-like arrangement of a plurality of teeth engageable by a pawl to prevent rotation of the spool in one direction. The opposed sides of the spool contacting the cord partially wrapped thereabout includes a plurality of ridges to minimize slippage of the cord on the spool. Upon exerting a pulling force on a first length of the cord extending from within the ratchet, the spool is caused to rotate to draw the second length of cord extending from the ratchet into the ratchet. Thereby, tension can be applied to the second length of cord as the first length of cord is pulled. The resulting tension force exerted on the second length of cord will tend to wedge the cord within the spool due to the ridges in the spool. Thereby, slippage of the cord about the spool due to the tension force exerted is essentially eliminated. To release the tension force, the pawl is pivoted out of engagement with the teeth to permit the spool to freely rotate in either direction.

Some variations of the above-described ratchet and those shown in the above referenced patents have been developed. However, the amount of tension force that can be applied has been essentially limited by the degree of pulling force manually exerted upon the free end of the cord. Usually, the tension force is 100 or so pounds.

SUMMARY OF THE INVENTION

In a first embodiment of the invention, a housing supports a spool mounted on a shaft journalled within opposed sides of the housing. A pivotable pawl precludes rotation of the spool in one direction but upon pivoting the pawl against a spring bias, the spool is free to rotate. A cord enters the housing, extends partially about the spool and exits the housing. Upon pulling on the entering cord, tension will be applied to the exiting cord with commensurate rotation of the spool. Ridges on opposed sides of the spool interact with the cord to prevent slippage. To increase the amount of force applied to the spool and thereby the tension force on the entering cord, one or both ends of a shaft supporting the spool includes a socket for engagement by a tool. The additional leverage available from such tool, acts through the spool to further increase the force on the entering cord. In another embodiment of the invention, a hollow shaft supporting the spool includes an aperture disposed between the sides of the spool for inserting the entering cord and drawing it out through the end of the shaft. Once the entering cord is taut, a tool is inserted in a socket at the other end of the shaft to provide leverage for rotating the spool and wrap the cord about the spool to increase the tension on the entering cord. In a third embodiment of the ratchet, a lever is pivotally mounted within the housing about the shaft for the spool. A cord enters the housing and partially extends about the spool and thereafter exits the housing. An initial tension is applied to the entering cord by pulling on the exiting cord. Thereafter, repetitive angular movement of the lever results in commensurate rotation of the spool and the ridges on the spool interacting with the cord draws the entering cord about the spool to increase the tension. Reverse rotation of the spool is prevented by a pawl selectively releasable from engagement with the spool. In a variant of this embodiment, the cord enters a hollow shaft through a hole in the shaft and exits through one end of the shaft. Once the entering cord is tight by pulling on the exiting cord, the lever is repetitively angularly moved to wrap the entering cord upon itself within the spool and thereby significantly increase the tension on the entering cord.

It is therefore a primary object of the present invention to provide a heavy duty ratchet for providing significant tensioning force upon a cord extending from the ratchet.

Another object of the present invention is to provide a ratchet for wrapping an entering cord upon itself within a spool to increase the tension force on the entering cord.

Still another object of the present invention is to provide a ratchet that may be engaged by a tool to cause rotation of a cord gripping spool to increase the tension on a cord entering the spool.

Yet another object of the present invention is to provide a ratchet having a lever for wrapping a cord entering a housing about a spool to increase the tension on the entering cord.

A further object of the prevent invention is to provide apparatus for doubling the tension force exertable by a ratchet.

A still further object of the present invention is to provide a ratchet with a removable tool for rotating the spool of the ratchet.

A yet further object of the present invention is to provide a ratchet with a holder for a removable flashlight.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
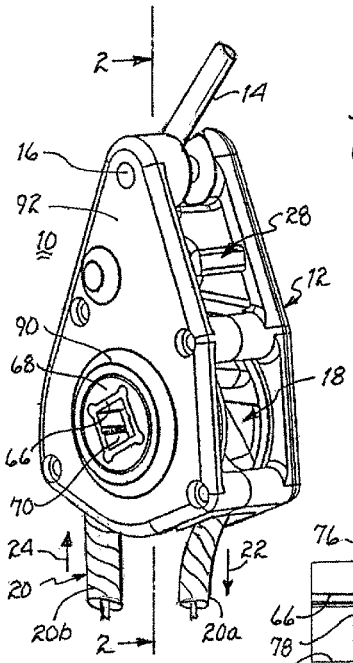
FIG. 1 is a three-quarter view of a ratchet.

Referring to FIG. 1, there is shown a ratchet 10 defined in part by a housing 12. A cord or hook 14 is secured to the upper end of housing 12 by a shaft 16 lodged in the housing. A spool 18 is rotatably mounted within the housing. A cord 20, extends into housing 12 and partially encircles spool 18. Upon pulling on exiting cord 20*a*, as presented by arrow 22, entering cord 20*b* is drawn into housing 12, as presented by arrow 24 and about spool 18 and the spool will rotate commensurately.

Figure 3:
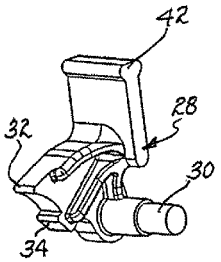
FIG. 3 is an isometric view of a pawl useable with the ratchet shown in FIGS. 1 and 2.
Figure 2:
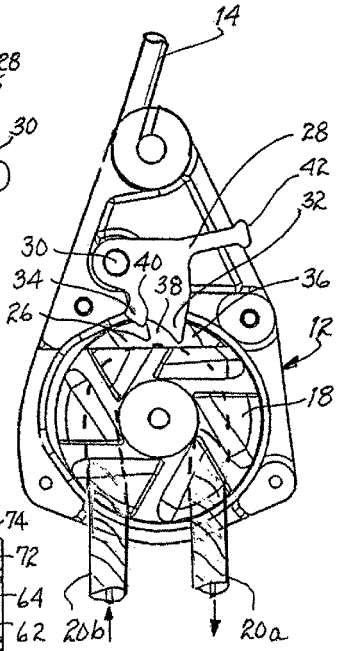
FIG. 2 is a partial cross-sectional view generally taken along lines 2-2, as shown in FIG. 1.

FIG. 2 is a partial cutaway view of ratchet 10 and essentially taken along lines 2-2, as shown in FIG. 1. Spool 18 includes a ring of teeth 26. A pawl 28, as shown in FIGS. 2 and 3, is pivotally mounted within housing 12 on shaft 30. The pawl includes a primary prong 32 and a secondary prong 34. In operation, the primary prong nests in the triangular space between two adjacent teeth 36, 38 and secondary prong 34 extends past tip 40 of tooth 38. Thereby, pawl 28 prevents rotation of spool 18 in the counter-clockwise direction, as illustrated in FIG. 2. To release the spool, arm 42 of prong 32 may be manually pivoted upwardly about shaft 30 to bring about disengagement of the primary and secondary prongs with the spool. Upon such release, the spool will freely rotate in either direction and either end of cord 20 may be pulled free of ratchet 10.

Figure 5:
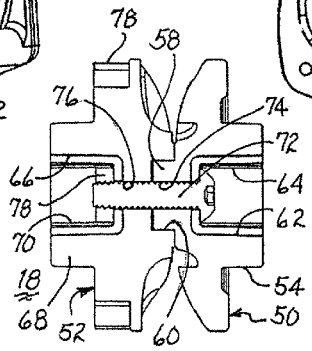
FIG. 5 is cross-sectional view of the spool.
Figure 4:
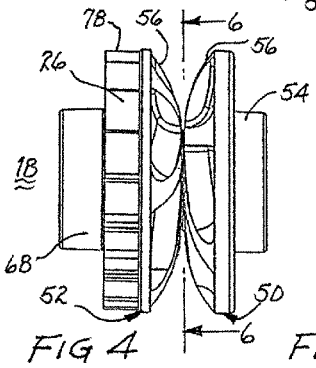
FIG. 4 is a side view of a spool.
Figure 6:
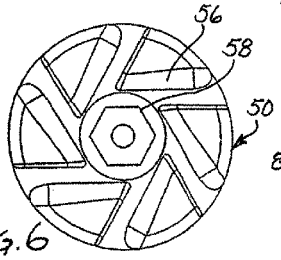
FIG. 6 is a partial cutaway view taken along lines 6-6, as shown in FIG. 4.

Spool 18 is shown in further detail with joint reference to FIGS. 4, 5 and 6. As particularly shown in FIG. 5, spool 18 includes two wheels 50, 52. Wheel 50 includes a hub 54 rotatably supported within a commensurate aperture in ratchet 10. The inwardly facing surface of wheel 50 includes a plurality of ribs 56, as shown in FIG. 6. These ribs may have various cross-sections as a function of the degree of deformation of a cord partially wrapped about the spool to create a serpentine-like configuration of the cord. Thereby, slippage of the cord about the spool is essentially precluded. Ribs 56 extend upwardly in non-radial orientation with respect to wheel 50. Wheel 52 includes similar ribs 56 but offset from the ribs in wheel 50. The cord extending partially about the spool will then have the serpentine-like configuration to enhance frictional interaction between the cord and the spool.

Wheel 50 includes a boss 58 mating with a cavity 60 in wheel 52. As depicted in FIG. 6, the boss and cavity may be hexagonal as illustrated to mate the two wheels together and prevent independent rotation therebetween. A cavity 62 is formed in hub 54. Preferably, this cavity is square in cross-section, as illustrated in FIG. 1. As the spool may be of plastic, a metal insert 64 may be incorporated to protect the hub and prevent distortion upon the application of a rotational force to hub 54.

Wheel 52 includes a hub 68 which is rotatably supported within the aperture in housing 12 and defined by ring 90. It is to be understood that a similar ring circumscribing an aperture for receiving hub 54 is also used. Wheel 52 also includes a cavity 66 within hub 68. This cavity may also be square in cross-section, as shown in FIG. 1. The function of cavity 66 is that of accommodating insertion of a socket wrench or other square tool, such as an Allen wrench, to apply a rotational force to spool 18 in excess of that available by pulling on cord 20*a* (FIG. 1). Because the spool may be of a plastic material, to protect cavity 66 from deformation or damage upon insertion of a tool, a metal insert 70 may be employed.

Wheels 50 and 52 are joined with one another upon insertion of boss 58 into cavity 60 to provide a non-rotational engagement between the two wheels. To retain the two wheels as a single unit, a machine screw 72 extends from within cavity 62 through a passageway 74 in wheel 50 and a passageway 76 in wheel 52. A nut 77 lodged within cavity 66 is threadedly engaged by screw 72 and prevents separation of wheel 50 from wheel 52.

A ring 78 of teeth 26 are formed on wheel 52. These teeth are engageable by pawl 28 (see FIGS. 1 and 2) to preclude rotation of spool 18 in one direction. By rotating pawl 28 about shaft 30 away from spool 18, the spool is free to turn in either direction as a result of a pulling force applied to either cord 20*a* or cord 20*b*.

As shown in FIGS. 1 and 4, hubs 54 and 68 are journalled within each of the sidewalls of housing 12. In particular, a re-enforcing ring 90 is formed as part of sidewall 92 and a similar re-enforcing ring is formed in the opposite sidewall. They serve as journalling surfaces for hubs 68 and 54 of spool 18. Upon applying torque to either hub through use of a socket wrench, Allen wrench or other tool, the forces exerted are countered by the strength of rings 90 in combination with the strength of sidewall 92.

Figure 7:
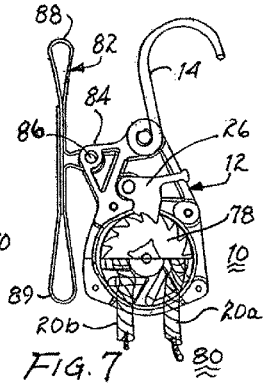
FIG. 7 illustrates a force increasing element attached to the ratchet.

Referring to FIG. 7, there is shown a variant ratchet 80 for doubling the load that may be imposed upon the ratchet. A loop 82 is pivotally secured to an extension 84 of housing 12 with a pin 86. By attaching a line or rope to hook 14, engaging it with an anchor or other element and returning it to loop section 88 of loop 82, ratchet 10 becomes essentially positionally fixed. By extending cord 20*b* to an item of interest to draw the item toward the anchor, the cord is returned and attached to loop section 89 of loop 82. By operating the ratchet by either pulling on cord 20*a* or engaging a socket wrench or Allen wrench with cavity 66 or cavity 62, a force can be exerted on the item of interest to urge it toward the anchor point. Because of the doubling of cord 20*b*, twice the force can be applied.

Figure 8:
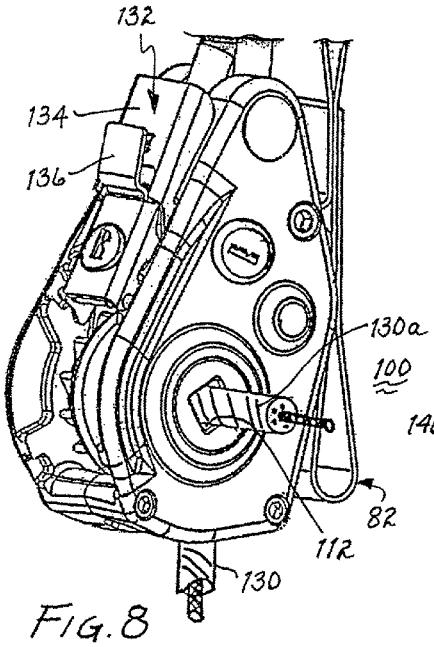
FIG. 8 is a three-quarter view of a variant ratchet.
Figure 9:
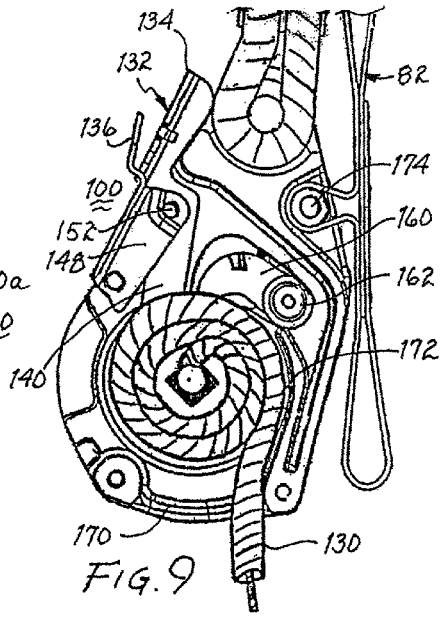
FIG. 9 is a partial cutaway view of the variant ratchet.
Figure 10:
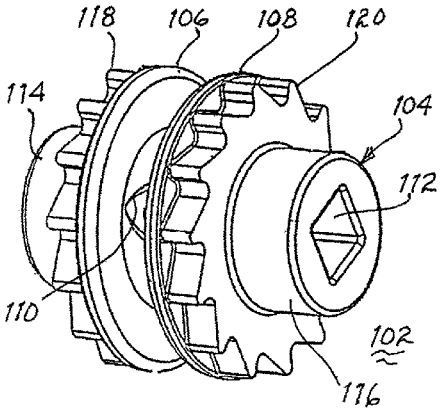
FIG. 10 is a three-quarter view of a spool for the variant ratchet.
Figure 11:
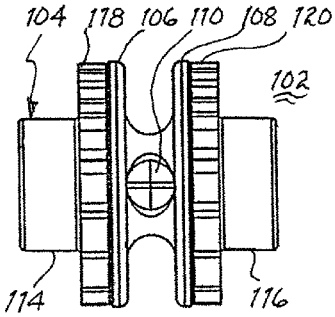
FIG. 11 is a side view of the spool shown in FIG. 10.

Referring to FIGS. 8 and 9, there is shown a variant ratchet 100. This variant ratchet includes a spool having a hollow shaft and an aperture formed through the wall of the shaft between the wheels of the spool. An entering cord is inserted through the aperture and the exiting cord is drawn out of the shaft through one end or the other. Once the entering cord is attached to an element of interest, the exiting cord is drawn until it becomes tight between the item of interest and the spool. Thereafter, the spool is rotated to wrap the entering cord about itself in the spool to increase the tension force on the entering cord attached to the item of interest. Rotation of the spool may be accomplished by a tool, such as an Allen wrench, socket wrench or other tool engaging the hollow shaft; alternatively, a lever attached to the spool may be pivoted repeatedly to effect rotation of the spool. The structure for accomplishing these features will be described below.

Referring jointly to FIGS. 8, 9, 10, 11, 12, and 12A, spool 102 will be described in detail. The spool includes a hollow shaft 104 supporting a pair of spaced apart discs 106, 108. An aperture 110 is formed in the wall of the shaft between the discs to provide access to passageway 112 disposed within hollow shaft 104. The passageway may be square in cross-section to permit engagement of passageway 112 by a tool inserted in either of hubs 114, 116. A toothed ring 118 is formed adjacent disc 106. A similar toothed ring 120 is formed adjacent disc 108. As particularly shown in FIGS. 12 and 12A, a metal insert 122 may be formed in passageway 112 within each of hubs 114, 116 to counteract the distending forces that may occur as a result of engagement of passageway 112 by a tool to cause rotation of spool 102.

Figure 12:
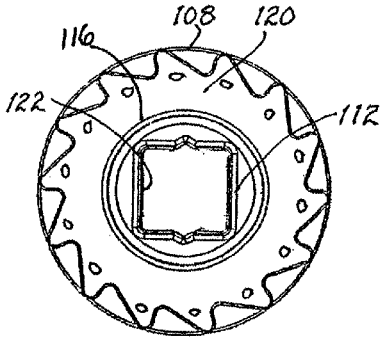
FIGS. 12 and 12A are opposed end views of the spool shown in FIG. 10.
Figure 12A:
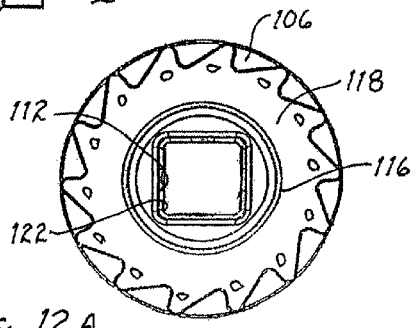

FIG. 12A is essentially an end view of toothed ring 118 adjacent disc 106. It shows hub 116 extending therefrom along with passageway 112. The end of passageway 112 through which cord 130*a* does not extend is illustrated. As the spool may be of plastic, it may be prudent to provide an insert 122 of metal to prevent damage to the plastic by a tool inserted into the passageway. Thus, a tension force may be applied to cord 130 by variant ratchet 100 by repetitive angular motion of lever 132 and/or by inserting a tool into passageway 112 to effect rotation of the spool.

Figure 13:
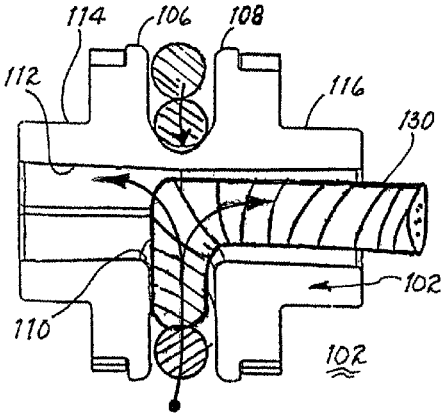
FIG. 13 is a partial cutaway view illustrating the cord within the spool shown in FIG. 10.
Figure 14:
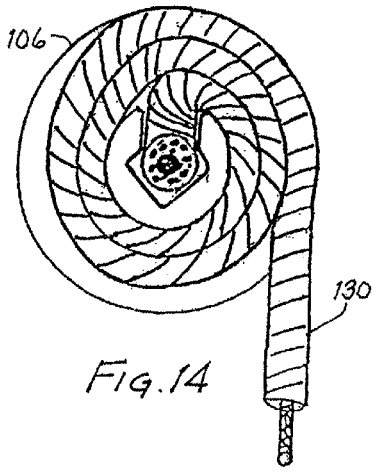
FIG. 14 is a side view illustrating the cord wrapped within the spool.
Figure 15:
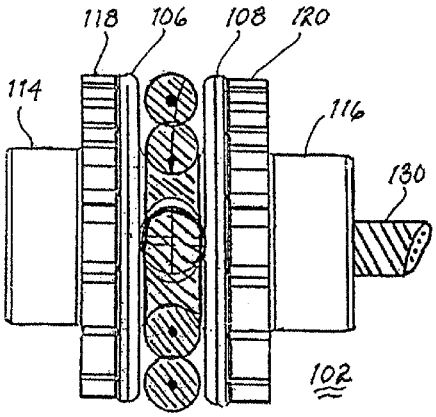
FIG. 15 is a side view of the spool with the cord wrapped thereabout.

Referring jointly to FIGS. 13, 14, and 15, operation of spool 102 will be described in further detail. A cord 130 is inserted through aperture 110 into passageway 112 and forced out through either hub 114 or hub 116; extension through hub 116 is shown in FIG. 13. The extending cord is drawn until the cord between variant ratchet 100 and the item of interest is taut. Thereafter, spool 102 is caused to rotate by application of a tool to the spool or by repetitive angular movement of lever 132 shown in FIGS. 8 and 9, the operation of which will be described below. The resulting rotational movement of the spool will cause cord 130 to be wrapped about itself intermediate discs 106, 108, as shown in FIGS. 13, 14, and 15. Such wrapping of the cord will provide significant additional tension on the cord attached to the item of interest. Because cord 130 is wrapped about itself, the resulting overlap of the section of cord extending into passageway 112 through aperture 110 will create significant friction that will prevent the cord from sliding from within the passageway out through aperture 110. Thereby, cord 130 will remain taut and apply a friction force commensurate with the degree of forced rotation of spool 102.

Figure 16:
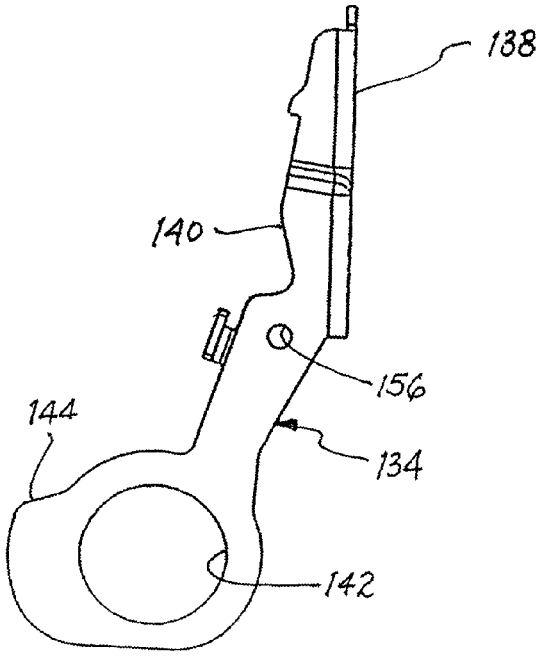
FIG. 16 illustrates a side view of the handle.
Figure 17:
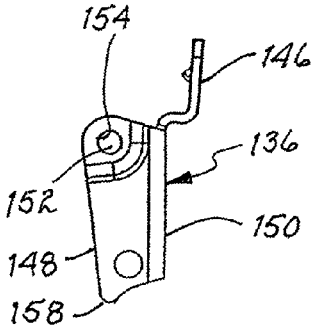
FIG. 17 illustrates the spring release.
Figure 18:
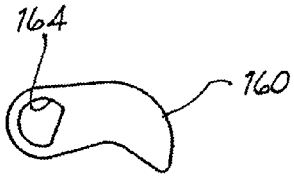
FIG. 18 illustrates the pawl.

Referring jointly to FIGS. 8, 9, 12, 13, 14, 15, 16, 17, and 18, the operation of lever 132 to cause rotation of spool 102 will be described. Lever 132 is formed by handle 134 and spring release 136. Handle 134, as shown in FIG. 16, includes a grip 138 and a pair of arms 140 extending therefrom. The lower end of each arm includes an opening 142 for penetrable engagement with respective one of hubs 114, 116 of spool 102. As set forth below, the handle includes a cam 144. Release 136 includes a tab 146 and a pair of skirts 148 extending from a base 150, as shown in FIG. 17. A pin 152 pivotally secures release 136 with handle 134 by engaging holes 154 in the release and holes 156 in the handle. Thereby, the release is pivotally attached to the handle. A spring, not shown, biases the release toward the handle in the counter-clockwise direction, as illustrated in FIGS. 8 and 9. In the fully biased position, end 158 of each skirt 148 of release 136 engages a tooth of the respective one of toothed rings 118, 120 shown in FIG. 10. Upon counter-clockwise pivoting of lever 132, the respective ends 158 of release 136 will bear against toothed rings 118, 120 and cause rotation of spool 102.

Reversed rotation of spool 102 is prevented by a pair of pawls 160 journalled on shaft 162 by engagement with aperture 164, as shown in FIG. 9. A bias spring, not shown, urges pawls 160 into engagement with the respective one of toothed rings 118, 120. Upon pivotal movement of lever 132 at the end of its rotational movement, cam 144 on each of arms 140 bear against the respective one of pawls 160 to cause clockwise pivotal movement of the pawls and disengagement of the pawls from the respective toothed ring. With such disengagement, spool 102 is free to rotate in either direction and any tension force on cord 130 will be relieved.

Referring specifically to FIG. 9, certain structure interior of variant ratchet 100 will be described. Cord 130 enters the variant ratchet through a slot 170 formed at the bottom of the variant ratchet. The cord is guided into and around the spool by a curved guide 172. A loop 82, as described above, may be attached to variant ratchet 100 by engagement with a pin 174. Thereby, the benefits of essentially doubling the tension force that can be exerted upon cord 130 would be available upon use of the loop, as will be described in more detail below.

Figure 19:
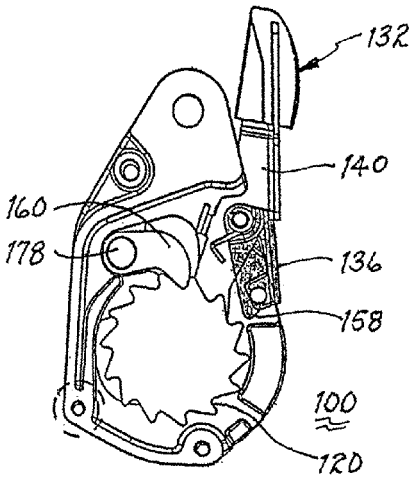
FIG. 19 illustrates a partial cutaway view of the variant ratchet prior to actuation of lever 132.
Figure 20:
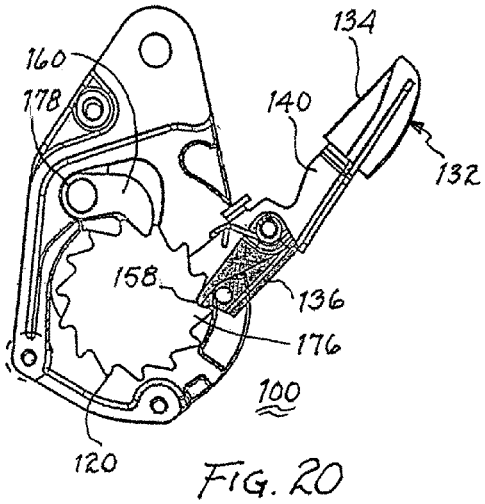
FIG. 20 illustrates a partial cutaway view of the variant ratchet upon initial movement of lever 132.
Figure 21:
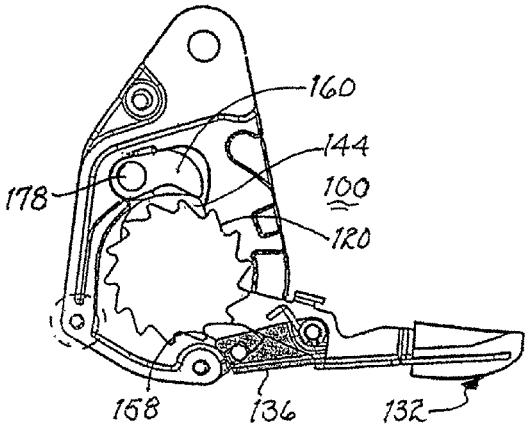
FIG. 21 illustrates a partial cutaway view of the variant ratchet upon full movement of lever 132.

Referring in particular to FIGS. 19, 20, and 21, the operation of lever 132 will be described in further detail. Upon pivotal movement of lever 132, end 158 of release 136 will engage a tooth 176 of toothed ring 120. Further pivotal movement of the lever will result in rotation of the toothed ring and commensurate rotation of spool 102. At the end of pivotal movement of lever 132, as shown in FIG. 21, cam 144 comes into engagement with a pawl 160 to angularly reposition the pawl about a pin 178 and thereby disengage the pawl from toothed ring 120. Upon such disengagement, along with disengagement of release 136, as shown in FIG. 20, the spool is free to rotate in either direction.

Figure 22:
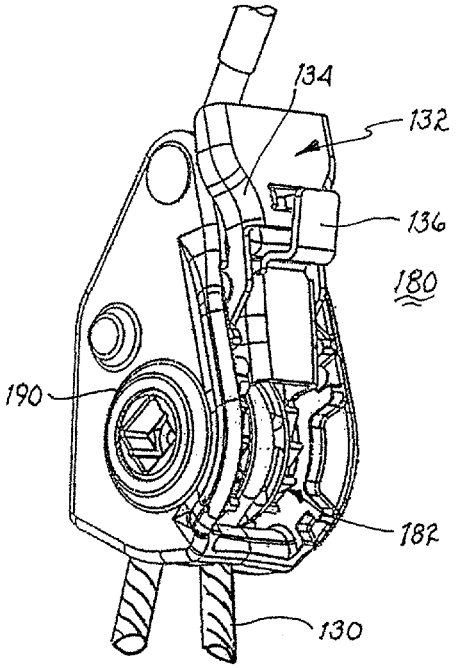
FIG. 22 illustrates a further variant ratchet wherein the cord enters the ratchet, partially wraps about the spool and exits the ratchet.
Figure 23:
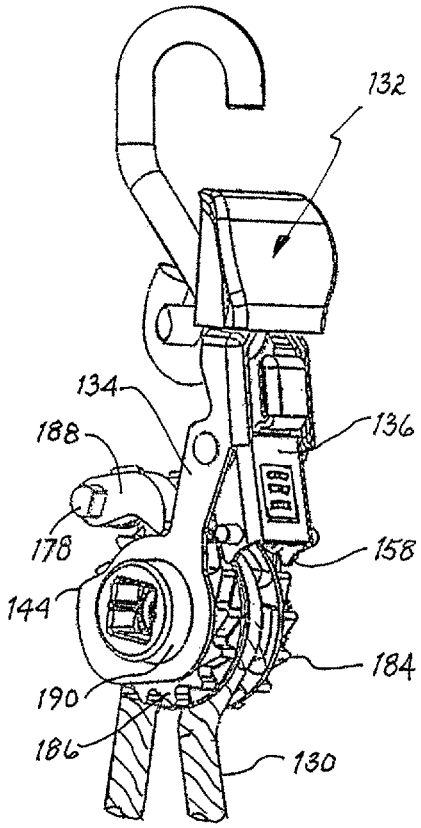
FIG. 23 illustrates the operative elements of the further variant ratchet shown in FIG. 22 without the housing.
Figure 24:
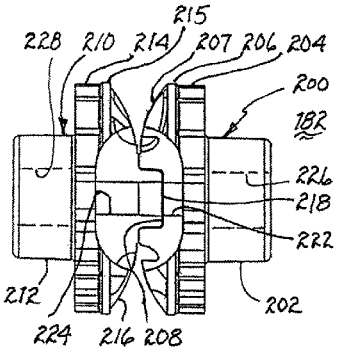
FIG. 24 is a side view of the spool within the further variant ratchet.
Figure 24A:
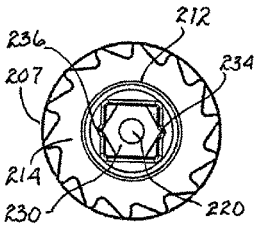
FIGS. 24A and 24B illustrate the toothed rings of the spool shown in FIG. 24.
Figure 24B:
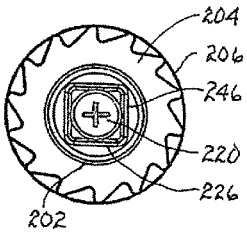

Referring to FIGS. 22 and 23, there is shown a further variant ratchet 180. This ratchet is similar to variant ratchet 100 in that a lever may be used to turn the spool. It is also similar to ratchet 10 in that the cord enters the ratchet, extends partly about a spool, and exits the ratchet through the same slot as the entering cord. More particularly, variant ratchet 180 includes a lever 132 formed by a handle 134 and a release 136. A spool 182 is incrementally rotated by repetitive angular movement of lever 132. As described above, the ends 158 of release 136 engage the teeth in teeth rings 184, 186. A pair of pawls, of which pawl 188 is shown, are supported upon a shaft 190. Lever 132 includes a pair of handles 134 engaging and rotating about the hubs (of which hub 190 is shown) of spool 182. Upon full pivotal movement of lever 132, cam surfaces 144 of the two handles engage respective pawls 188 to pivot the pawls out of engagement with the respective teeth rings. Thereby, spool 182 is free to rotate.

Referring jointly to FIGS. 24, 24A, 24B, 25, 25A, 25B, and 26, further detail attendants the assembly of spool 182 will be described. The spool includes two parts essentially duplicative of one another except for the respective sections mating the two parts and precluding independent rotation of the parts. Part 200 includes a hub 202 extending from the center of a toothed ring 204. A disc 206 adjacent the toothed ring includes a plurality of ridges 207 or the like (to be described) for gripping the cord engaging the spool. A centrally located cavity 208 that may be hexagonal, is illustrated. Part 210 also includes a hub 212 extending from a toothed ring 214 and centered thereupon. A disc 215 adjacent the toothed ring includes a plurality of ridges 216 for gripping the cord engaging the spool. A boss 218 extends from part 210 for mating engagement with cavity 208. The boss may also be hexagonal to mate with cavity 208. It is to be understood that the boss and mating cavity may be square, triangular, or other configuration that precludes independent rotation of one part relative to the other part.

Figure 25A:
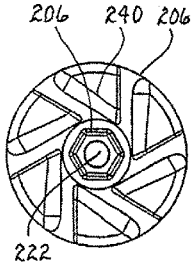
FIGS. 25A and 25B illustrate ribbed surfaces of a spool.
Figure 25B:
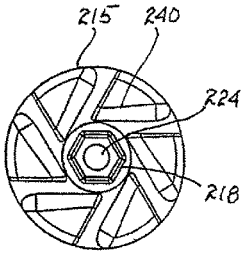
Figure 25:
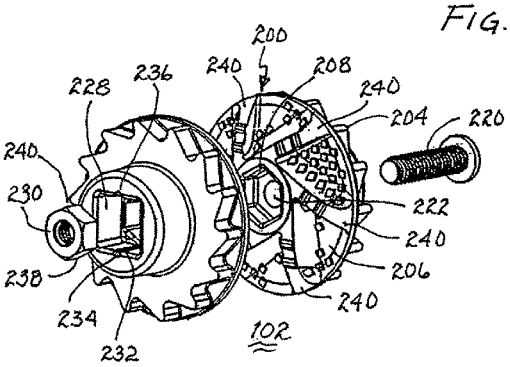
FIG. 25 is an exploded view of the components of the spool shown in FIG. 24.
Figure 26:
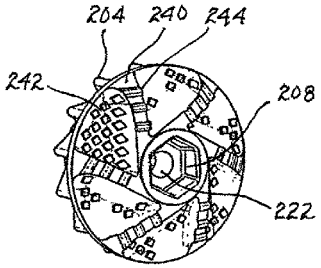
FIG. 26 illustrates various protrusions that may be located on any of the ridged discs of any of the spools.

Parts 200 and 210 are mated with one another and retained in such mating relationship by a machine screw 220 extending through passageway 222 in section 200 and into passageway 224 of section 210. Passageway 222 in part 200 mates with a further passageway 226 in hub 202, which passageway is preferably square in cross-section. Similarly, passageway 224 mates with a further passageway 228 within hub 212. As shown in FIG. 25, passageway 228 is preferably square in cross-section. Machine screw 220 extends through passageway 222 in part 200 and into and through passageway 224 in part 210. A nut 230 is located within passageway 228 for threaded engagement with machine screw 220. Preferably, a metal insert 232 is lodged within passageway 228. This insert includes a pair of opposed channels 234, 236 to receive ridges 238, 240 of nut 230. Thereby, rotation of the nut in response to threaded engagement of machine screw 220 is precluded. Parts 200 and 210 become mated within one another in a unitary manner to prevent independent rotation of the part.

Passageway 228 and its metallic insert 232 (which may be on each end of the passageway) accommodates the use of a tool inserted into this passageway to enhance turning the spool to increase the tension of the cord being drawn into the ratchet. The use of metal insert 232 has the further benefit of protecting the spool against damage due to the forces applied since it is contemplated that the spool will be of a plastic material.

Slippage of the cord about spool 102 is highly undesirable. Such slippage is prevented by a plurality of ridges 240 on each face of discs 206, 215. Ridges 240 are non-radially oriented from generally the center of each disc to a location essentially at the perimeter of the disc. The ridges may be rectangular in cross-section or they may slope from a high point to the surface of the disc. The shape of such slope may be flat, convex or concave. Alternatively, the ridges may be triangular in cross-section. As particularly depicted in FIG. 26, a plurality of protrusions 242 may be formed intermediate the ridges to enhance frictional engagement with a cord partially wrapped about the spool. As particularly illustrated in FIG. 26, ridges 240 may include one or more slots 244. Various other surface disruptive elements may be formed on discs 206, 215 to enhance friction between the cord partially wrapped about the spool and the spool itself.

Figure 28:
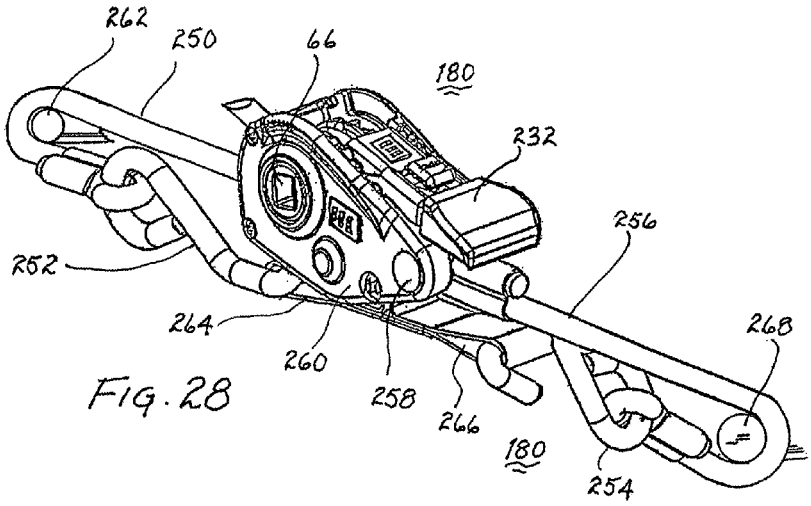
FIGS. 27 and 28 illustrate the use of a pair of loops secured to a ratchet housing for doubling the force exertable by one of the described ratchets.
Figure 27:
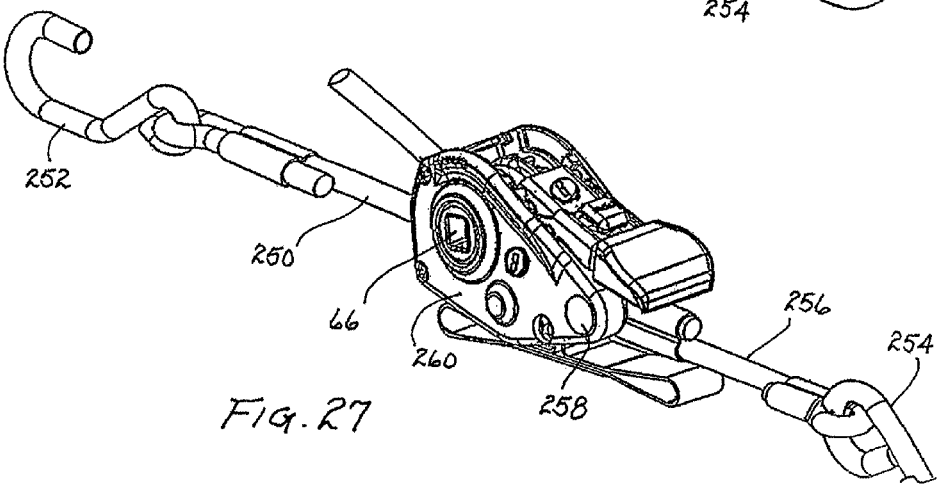

Referring jointly to FIGS. 27 and 28, ancillary elements are illustrated which render any of the ratchets described capable of doubling the lifting force or tension force exerted. For illustrative purposes, ratchet 180 is identified. Cord 250 extends from the spool within ratchet 180. A hook 252 is attached to the end of cord 250. Similarly, a hook 254 is attached to a cord 256 extending from the top of ratchet 180. This cord is supported by a pin 258 extending through the upper end of housing 260. Cord 250 is in engagement with an element 262 to be lifted or otherwise urged toward ratchet 180. After engaging element 262 of interest, hook 252 is engaged with loop 264 attached to ratchet 180 (note in particularly FIGS. 7, 8 and 9). Similarly, hook 254 is brought into engagement with loop 266 after engaging an anchor 268. The spool within ratchet 180 is rotated through manipulation of lever 232, as described above, or by insertion of a tool into cavity 66. Such rotation will draw cord 250 into and through the ratchet and thereby exert a force on element 262 and attempt to draw it toward anchor 268. This doubling of the cords between anchor 262 and the element 262 will result in doubling the lifting capacity of ratchet 180 or result in doubling of a tension force applied by cord 250. It may be noted that the use of loops 264 and 266 assert no significant force on the ratchet in that the ratchet primarily serves as a location for mounting the loops and the loops themselves withstand the forces applied thereto.

Figure 29:
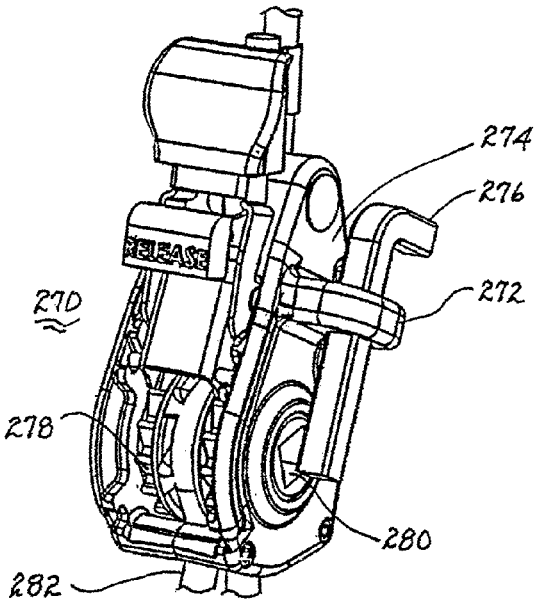
FIG. 29 illustrates a holder mounted on the housing of any of the ratchets described for supporting a tool.
Figure 30:
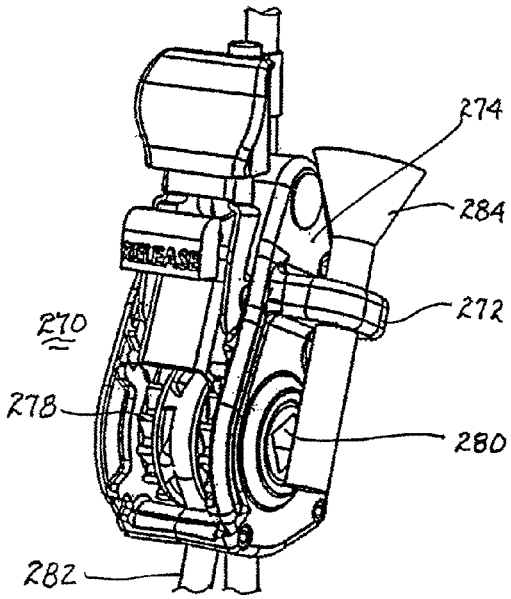
FIG. 30 illustrates a holder mounted on the housing of any of the ratchets described for supporting a flashlight.

FIGS. 29 and 30 illustrate a ratchet 270, which ratchet may be any one of the above-described ratchets. This ratchet may include a holder 272 attached to and extending from housing 274 of the ratchet. The holder serves the purpose of holding a tool 276 for urging rotation of spool 278 disposed within the housing by engagement with cavity 280. The tool illustrated is essentially an Allen wrench either end of which may be inserted into cavity 280 to assist in rotating the spool and increase the tension on cord 282 being drawn into the ratchet. FIG. 30 is essentially duplicative of FIG. 29 except that holder 272 supports a flashlight that may be useful to have in dim or dark environments wherein ratchet 270 is being operated.

While the term "cord" has been used herein, it is to be understood that a cord having an internal strengthening wire or cable (as shown in FIG. 1) may be used. Other ropes or rope-like lengths of material may also be used.

I claim:

1. A ratchet, said ratchet comprising:

(a) a spool having a pair of wheels non-rotatably secured to one another and defining a channel therebetween for supporting a section of a cord extending partially within said channel, said spool including a hub extending from each wheel of said pair of wheels;

(b) a housing including opposed sides, each side of said opposed sides including an opening for rotatably supporting one of said hubs;

(c) an opening disposed in said housing for accommodating passage of said cord;

(d) a multi-faceted passageway disposed in each of said hubs for receiving a tool to cause rotation of said spool and a metal insert disposed adjacent the sides of each of said passageways to serve as bearing surfaces upon insertion of the tool into either of said passageways; and (e) a spring loaded pawl biased in one direction for engaging at least one of said wheels to prevent rotation of said spool in one direction, said pawl being moveable in another direction to disengage from said wheel and permit rotation of said spool in either direction.

2. The ratchet as set forth in claim 1 wherein each of said wheels includes a plurality of non-radially aligned ribs for engaging the cord.

3. The ratchet as set forth in claim 1 wherein one of said wheels includes a non-circular boss and the other of said wheels includes a cavity configured to receive said boss and to prevent independent rotation of one wheel relative to the other wheel.

4. The ratchet as set forth in claim 3 including a shoulder disposed at the bottom of said passageway in each of said wheels, a reduced diameter passageway extending between said shoulders and a bolt extending into and out of said reduced diameter passageway and a nut disposed at the bottom of one of said passageways for threadedly engaging said bolt extending from said reduced diameter passageway to secure said pair of wheels with one another.

5. The ratchet as set forth in claim 4 wherein said insert disposed in said passageway non-rotatably retains said nut.

6. The ratchet as set forth in claim 1 wherein one wheel of said pair of wheels includes a toothed ring for engagement by said pawl.

7. The ratchet as set forth in claim 6 wherein said pawl includes a primary prong for insertion in the space between a pair of adjacent first and second teeth of said toothed ring and bearing against said first tooth, a secondary prong for engaging the tip of said second tooth and an arm for pivoting said pawl out of engagement with said toothed ring.

8. The ratchet as set forth in claim 1 including a holder for supporting the tool on said ratchet.

9. A ratchet, said ratchet comprising:

(a) a spool having a hollow shaft defining a passageway;

(b) a pair of discs mounted on said shaft in spaced apart relationship defining a channel;

(c) an aperture disposed in said shaft intermediate said pair of discs and in communication with said passageway;

(d) a toothed ring disposed adjacent each disc of said pair of discs;

(e) a hub extending laterally from each toothed ring of said pair of toothed rings;

(f) a housing, said housing including a pair of sidewalls and an aperture in each sidewall of said pair of sidewalls for supporting one of the hubs of said pair of hubs;

(g) a lever pivotally supported on said pair of hubs, a release pivotally supported on said lever, said release including a pair of ends for engaging respective ones of said pair of toothed rings, whereby pivotal movement of said lever causes said pair of ends to engage the teeth of said pair of toothed rings to urge rotation of said spool in one direction;

(h) a pair of spring loaded pivotable pawls for engaging the teeth of said pair of toothed rings to prevent rotation of said spool in the other direction;

(i) a cam extending from said lever for engaging said pair of pawls upon pivotal movement of said lever to a certain location and cause pivotal movement of said pawls out of engagement with said pair of toothed rings, whereby, upon insertion of one end of a cord through said aperture intermediate said discs and laterally through said hollow shaft permits pulling the cord tight between an object engaged by the other end of the cord and said ratchet and adding tension to the cord is effected by pivotal movement of said lever resulting in rotation of said spool to wrap the cord about itself within said channel.

10. The ratchet as set forth in claim 9 wherein at least one end of said passageway is square in cross-section to receive a tool for urging rotation of said spool and wrapping the cord within said channel.

11. The ratchet as set forth in claim 9 wherein said passageway is square in cross-section, whereby a tool may be inserted in either end of said passageway to urge rotation of said spool.

12. The ratchet as set forth in claim 9 wherein at least one end of said passageway is non-circular and configured to receive a tool for urging rotation of said spool.

13. A ratchet, said ratchet comprising:

(a) a spool having a pair of wheels non-rotatably secured to one another and defining a channel therebetween for supporting a section of a cord extending partially within said channel, said spool including a hub extending from each wheel of said pair of wheels;

(b) a housing including opposed sides, each side of said opposed sides including an opening for rotatably supporting one of said hubs;

(c) an opening disposed in said housing for accommodating passage of said cord;

(d) a passageway disposed in at least one of said hubs for receiving a tool to cause rotation of said spool;

(e) a lever pivotally supported on said pair of hubs, a release pivotally supported on said lever, said release including a pair of ends for engaging respective ones of said pair of toothed rings, whereby pivotal movement of said lever causes said pair of ends to engage the teeth of said pair of toothed rings to urge rotation of said spool in one direction;

(f) a pair of spring loaded pivotable pawls for engaging the teeth of said pair of toothed rings to prevent rotation of said spool in the other direction; and (g) a cam extending from said lever for engaging said pair of pawls upon pivotal movement of said lever to a certain location and cause pivotal movement of said pawls out of engagement with said pair of toothed rings.

14. The ratchet as set forth in claim 13 wherein at least one end of said passageway is square in cross-section to receive a tool for urging rotation of said spool.

15. The ratchet as set forth in claim 13 wherein said passageway is square in cross-section whereby a tool may be inserted in either end of said passageway to urge rotation of said spool.

16. The ratchet as set forth in claim 13 wherein at least one end of said passageway is non-circular and configured to receive a tool for urging rotation of said spool.

17. The ratchet as set forth in claim 13 wherein each disc of said pair of discs includes a surface supporting a plurality of non-radially aligned ribs extending toward the circumference of said disc.

18. The ratchet as set forth in claim 13 including a surface on each disc of said pair of discs and protrusions disposed on said surfaces for increasing the mechanical interference between said surfaces of said discs and a cord disposed intermediate said pair of discs.

* * * * *